US006428268B1

(12) United States Patent
Addie et al.

(10) Patent No.: US 6,428,268 B1
(45) Date of Patent: Aug. 6, 2002

(54) PUMP WITH AUXILIARY IMPELLER VANE INLET DEVICE

(75) Inventors: Graeme R. Addie, Augusta, GA (US); Peter Hergt, Frankenthal (DE)

(73) Assignee: GIW Industries, Inc., Grovetown, GA (US)

( * ) Notice: Subject to any disclaimer, the term of this patent is extended or adjusted under 35 U.S.C. 154(b) by 3 days.

(21) Appl. No.: 09/641,572

(22) Filed: Aug. 18, 2000

Related U.S. Application Data

(60) Provisional application No. 60/150,092, filed on Aug. 20, 1999.

(51) Int. Cl.[7] ..... F01D 00/00
(52) U.S. Cl. ..... 415/1; 415/206
(58) Field of Search ..... 415/1, 204, 206, 415/208.1, 212.1, 182.1

(56) References Cited

U.S. PATENT DOCUMENTS 2,454,390 A * 11/1948 Jacobsen ..... 415/204
2,922,431 A * 11/1960 Jensen ..... 415/212.1
3,048,117 A * 8/1962 Franzen et al. ..... 415/212.1
4,475,868 A * 10/1984 Renger ..... 415/206
4,789,301 A * 12/1988 Osborne et al. ..... 415/206
5,145,256 A * 9/1992 Wiemers et al. ..... 366/336
5,403,151 A * 4/1995 Noyes ..... 415/182.1
5,722,813 A * 3/1998 Li et al. ..... 415/208.1
6,102,657 A * 8/2000 Chalberg et al. ..... 415/204

* cited by examiner

*Primary Examiner*—F. Daniel Lopez
*Assistant Examiner*—James M McAleenan
(74) *Attorney, Agent, or Firm*—Womble Carlyle Sandridge & Rice, PLLC

(57) ABSTRACT

Disclosed is a slurry conduit for connecting to a centrifugal pump for transporting a slurry mix of solids and liquids. The conduit includes an inclined upstream section having a reduced cross section whereby a concentration gradient formed within the slurry conduit is reduced. The inclined section forces any sliding bed or stratified slurry upwards as it goes towards the apex of the reduced section. The slurry entering the pump has a substantially monolithic or nonstriated composition, which reduces the wear on the pump.

21 Claims, 4 Drawing Sheets

PUMP WITH AUXILIARY IMPELLER VANE INLET DEVICE

This application claims the benefit of U.S. Provisional Application No. 60/150092 filed Aug. 20, 1999.

FIELD OF INVENTION

The present invention relates to centrifugal pumps, and more particularly to centrifugal pumps used for transporting slurries and other abrasive-containing fluids.

BACKGROUND

Vast tonnages of solid-liquid mixtures, known as slurries, are pumped every year. The largest quantities are pumped in the dredging industry, which continually requires maintaining navigation in harbors and rivers, altering coastlines and winning material for landfill and construction purposes. As a single dredge may be required to maintain a throughput of 7000 tons of slurry per hour or more, very large centrifugal pumps are used.

The manufacture of fertilizer is another process involving massive slurry-transport operations. Phosphate is recovered by huge draglines in open-pit mining operations which is then slurried and pumped to wash plants through pipelines with a typical length of about 10 kilometers. Each year some 34 million tons of matrix are transported in this manner. The phosphate industry employs centrifugal pumps that are generally smaller than those used in large dredges, but impeller diameters up to 1.4 m are common, and drive capacity is often in excess of 1000 kW. The transport distance is typically longer than for dredging applications, and hence a series of pumping stations is often used.

Many other types of open-pit mining operations use slurry transport, and the number of such applications is increasing as it becomes clear that, for many short-haul and medium-haul applications, slurry transport is more cost-effective than transport by truck or conveyor belt.

Partially processed material from mining and metallurgical operations and other industries is often already in slurry form, facilitating pipe transport. Much of this is carried out using relatively small lines.

Since the purpose of a slurry pipeline is to transport solids, the higher the concentration of solids in the pipeline the more efficient and less costly it is to pump per unit of solids being transported. While it is easier to pump fine solids, grinding such solids to a small size is costly, thus large sized solids are commonly pumped. Larger sized solids and higher concentrations, however, result in higher wear inside the pump and particularly wear to the impeller vanes and shrouds.

The major erosive mechanisms resulting in pump wear are sliding abrasion and particle impact. The sliding-abrasion mode of wear typically involves a bed of contact-load particles bearing against a surface and moving tangentially to the surface. In pipelines, the stress normal to the surface is caused by gravity. The submerged weight of the particles not suspended by the fluid must be carried by intergranular contacts. The analysis of the motion of these contact-load (bed-load) solids in pipes has been developed over many years (Wilson et al., 1973), with some of the basic concepts dating from Bagnold's (1956) work on the flow of cohesionless grains in fluids. For sliding abrasion, the erosion rate depends on the properties of particles and wear surfaces, the normal stress and the relative velocity.

Normal stress is enhanced when the flow streamlines are curved, as in an elbow. In this case, there is a centrifugal acceleration equal to $u^2/r$, where u is the local velocity and r is the radius of curvature of the stream lines. This acceleration is often greater than that of gravity, producing a commensurate increase in the normal stress between the moving contact-load solids and the wall material, thus increasing the rate of sliding-abrasion wear. Such a wear type of behavior can cause elbows to wear, and is also very important in pump casings and along the surface impeller vanes where sliding abrasion in most areas tends to dominate.

A second type of wear is the particle-impact mode, which occurs where individual particles strike the wearing surface at an angle, despite the fact that the fluid component of the slurry is moving along the surface. Removal of material over time occurs through small-scale deformation, cutting, fatigue cracking or a combination of these, and thus depends on the properties of both the wearing surface and the particles. Ductile materials tend to exhibit erosion primarily by deformation and cutting, with the specific type depending on the angularity of the eroding particles. Brittle or hardened materials tend to exhibit fatigue-cracking erosion under repeated particle impacts. For a given slurry, the erosion rate depends on properties of the wearing surface such as hardness, ductility, toughness and microstructure. The mean impact velocity and mean angle of impact of the solids are also important variables, as are particle characteristics such as size, shape and hardness, and the concentration of solids near the surface.

The particle-impact type of erosion occurs because the trajectories of the individual particles do not follow the stream lines of the average flow. This behavior is important where the acceleration produced by strongly curving stream lines throws the particles towards a nearby surface, as occurs at the impeller vane inlets. Moreover, pumps and pipelines transporting water-based settling slurries almost invariably operate in highly turbulent eddies. The impact erosion associated with turbulence is best exemplified by the conditions in the upper portion of a settling slurry pipeline. Here removal of material occurs as in other types of impact erosion, although the impact vehicles and angles are more random.

It is expected that erosion by particle impact will be more effective than sliding abrasion provided that an equal number of particles are involved in each mechanism. The required conditions apply for low solids concentrations or cases where only a small fraction of the solids moves as contact load. The moving contact-load particles coming from upstream will be spaced sufficiently far apart to allow speedy incoming particles to erode the surface by impact. As a result, the local wear rate may be high. However, with larger solids concentrations the contact-load particles will be closer together.

An increase in particle concentration also results in increased wear. When this occurs as a result of a variation of concentration or stratification, then local wear will occur which could cause a drop-off in performance before the remainder of the pump part has achieved its full life.

It is also very common to see high local wear at the inlet edge of the vanes of an impeller when the slurry particle size is over 100 micron in size and the particles are concentrated towards the bottom on the impeller inlet.

Thus, there is a need for presenting a more uniform particle concentration profile to the centrifugal pump closer to that of zero velocity impact to reduce wear.

SUMMARY

The present invention comprises a slurry conduit for connecting to a centrifugal pump for transporting a slurry mix of solids and liquids. The conduit includes an inclined upstream section having a reduced cross section whereby a concentration gradient formed within the slurry conduit is reduced. The inclined section forces any sliding bed or stratified slurry upwards as it goes towards the apex of the reduced section. As the slurry leaves the reduced cross section, it falls slowly back to the bottom of the pipe. Before the slurry can settle it enters the centrifugal pump. When entering the pump, the slurry has a substantially monolithic or nonstriated composition, which reduces the wear on the pump.

In an additional embodiment, the slurry conduit for connecting to a centrifugal pump for transporting a slurry mix of solids and liquids comprises a venturi section. The venturi section has a reduced cross section whereby a concentration gradient formed within the slurry conduit is reduced.

Furthermore, a process is provided for reducing a concentration and velocity gradient formed within a slurry conduit. The process comprises the steps of uplifting a portion of the slurry within the conduit and then delivering a substantially nonstriated slurry stream to a centrifugal pump.

DETAILED DESCRIPTION

The present invention is designed to improve the rate of wear upon an impeller vane inlet of a centrifugal pump. The invention comprises a slurry conduit connected to an inlet of a centrifugal pump. The conduit transports a slurry mix of solids and liquids to the centrifugal pump.

The conduit further includes an inclined upstream section having a reduced cross section whereby a concentration gradient formed within the slurry conduit is reduced. The inclined section forces any sliding bed or stratified slurry upwards as it goes towards the apex of the reduced section. As the slurry leaves the reduced cross section, it falls slowly back to the bottom of the pipe. Before the slurry can settle it enters the centrifugal pump. When entering the pump, the slurry has a substantially monolithic or nonstriated composition, which reduces the wear on the pump.

Figure 1:
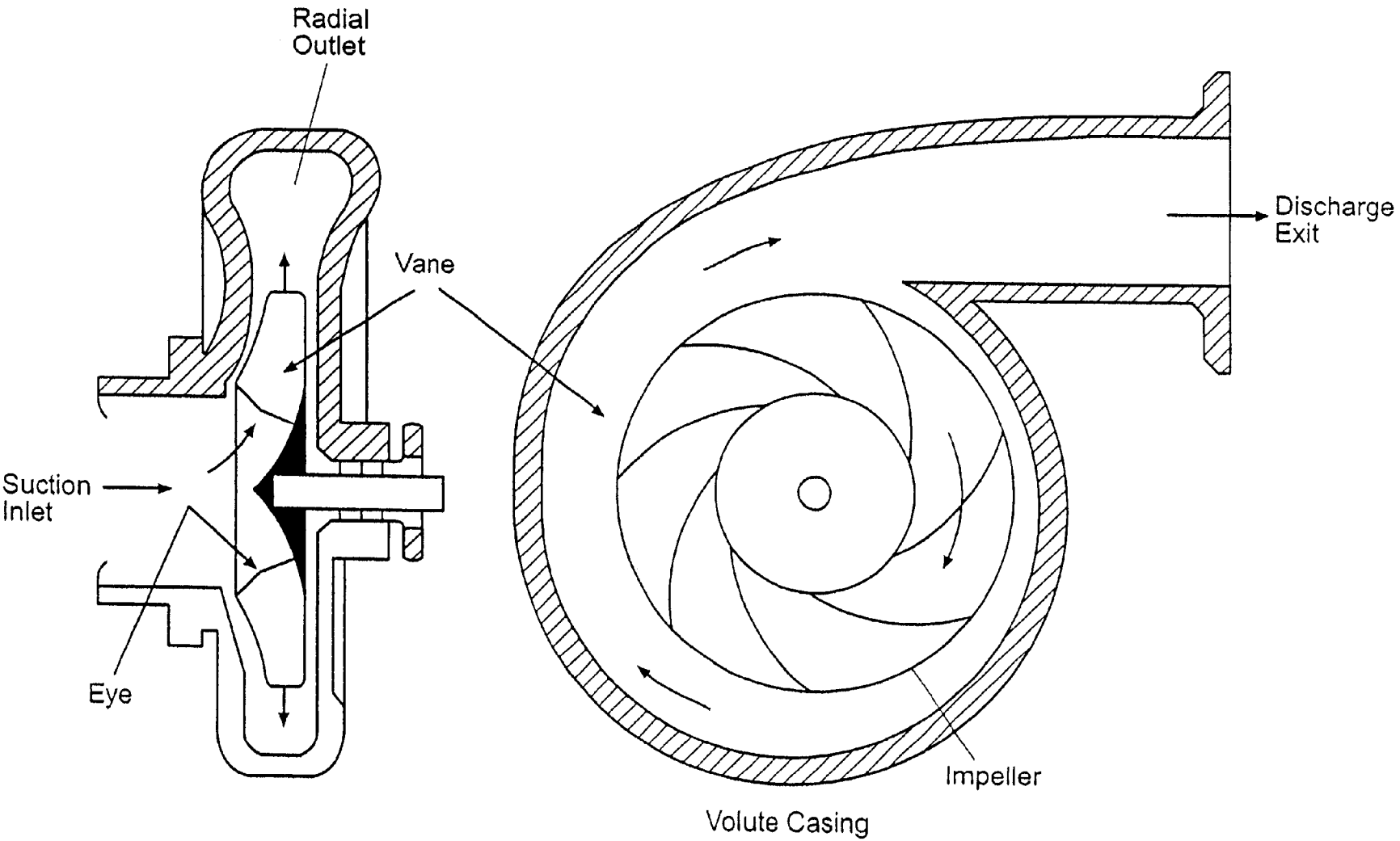
FIG. 1 illustrates a cross sectional view of a typical centrifugal pump, including the inlet, vanes and impeller.

As illustrated in FIG. 1, a centrifugal pump has two main components. The first is the rotating element comprising a shaft and impeller, which includes the vanes that act on the fluid. The second component is the stationary element made up of the casing or shell which encloses the impeller, together with the associated stuffing boxes and bearings. In any hydraulic pump design, there is usually more than one combination of component dimensions that can be arranged to give the required specified performance characteristics. The combination selected will depend on the intended application, and on any hydraulic or mechanical limitations.

In slurry pumps, a number of limitations are imposed. These include the need to pass large solids, the requirement for a robust rotating assembly because the slurry density exceeds that of water, and the desirability of thicker sections in order to minimize the effects of wear.

Centrifugal pumps exist in a wide variety of arrangements to suit different applications, and may comprise a number of stages of impeller and collector. Slurry pumps show less variety. They are normally single-stage end-suction type, and are usually of radial or mixed-flow configuration. They commonly have volute-type collectors, which are often modified to concentric or semi-concentric form in order to reduce the effect of wear on the shell. Sections of a representative end-suction single-stage volute-casing pump are shown in FIG. 1.

Flow through pumps can be quite complicated, and in order to aid description, certain directions or coordinates must be specified. The axial direction is parallel to the shaft of the pump, and positive in the direction of the axial component of the inflow, and the radial direction is directly outward from the centerline of the shaft. The tangential direction is perpendicular to both axial and radial directions, representing the tangent to the circular path of a rotating point. Points on the impeller have only tangential velocity, given by $\omega r$ or $2\pi nr$ where $\omega$ is angular velocity in radians per second, n is in revolutions per second, and r is the radius from the shaft centerline. A further direction needed for mixed-flow pumps is the meridional direction. This direction lies within a plane passing through the shaft centerline and follows the projection of the fluid streamlines onto this plane. Thus, the meridional direction has both radial and axial components in the case of mixed flow, but coincides with the radial velocity triangles direction for a pump and radial flow.

The impeller inlet angle is calculated to give shock-free entry at the pump design flow with some volumetric recirculation efficiency allowance. This is usually assumed to be about 95%.

The impeller meridional section and location of the inlet edge are almost always such that flow across the inlet edge is a combination of axial and radial movement. The tangential velocity of the inlet edge of the vane varies so the inlet angle that gives shock-free entry will vary also.

Figure 5:
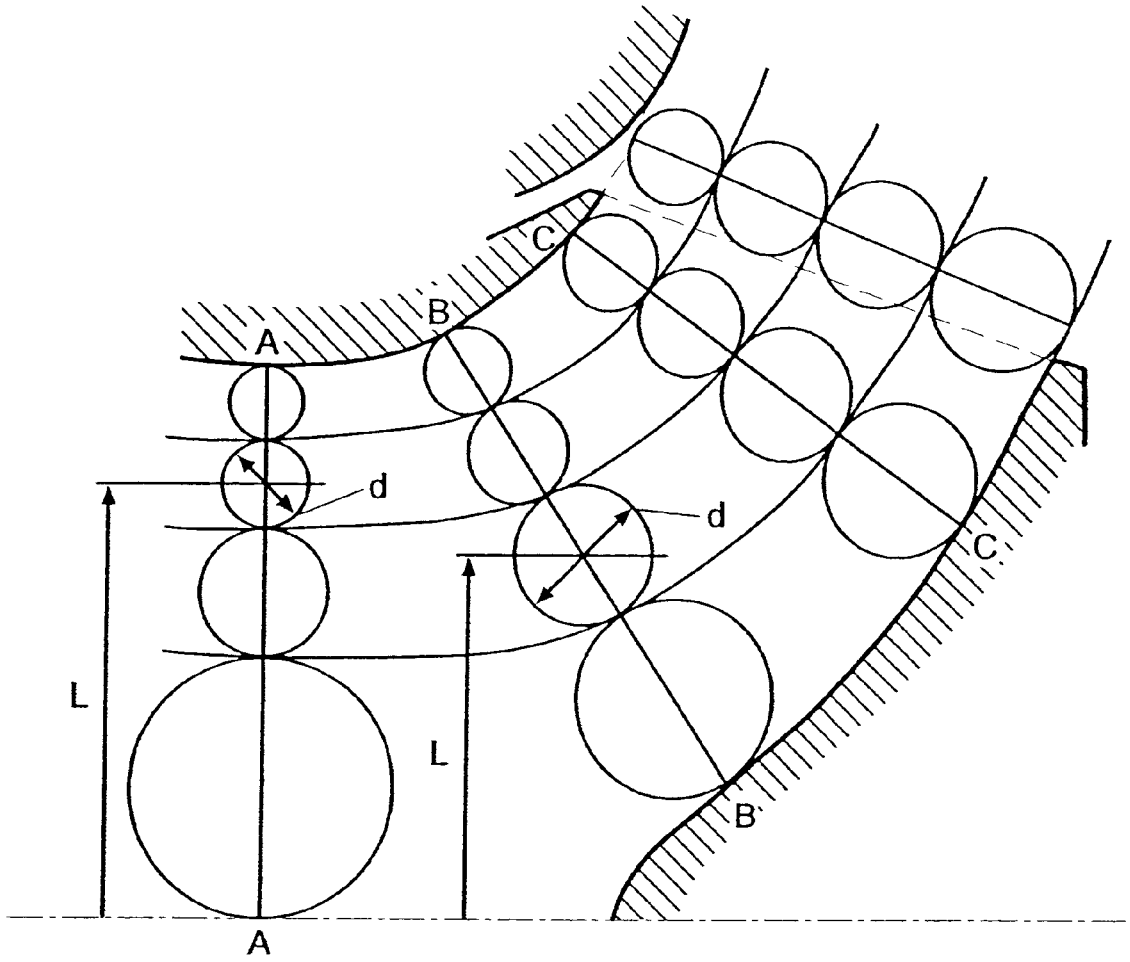
FIG. 5 is a schematic diagram illustrating the determination of the meridional stream lines.

To get the inlet angle, it is normal to break the flow down into a series of streamtubes of equal volumes using a series of tangential circles across a section as shown in FIG. 5 where the product of the radius and diameter of the circles across a section remain constant.

The inlet angle of the vane at the center of each streamtube can then be $$\beta^1 = \text{artan}\ \frac{C_{m1}}{U_1} \quad \text{(for radius location r only)}$$

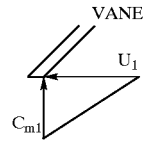

calculated using the relation below.

where t is the vane thickness $C_{m1}$ is the meridional velocity of the solids at the center of the streamtube in the plane of the stream line.

$U_1$ is the tangential velocity of inlet edge of vane.

Since the vane has thickness (and reduces the area available), some allowance must be made for volumetric losses, the value of $C_{m1}$ must be found from the following:

$$C_{ml} = \frac{Q}{d \cdot (2\pi r_2 - t \cdot Z/\sin\beta_1) \cdot \eta_v \cdot s}$$

$Q$ = design flow $s$ = number of streamtubes $Z$ = number of vanes $d$ = width of streamtube $r$ = radius of streamtube $\eta v$ = volumetric efficiency Since $\beta_1$ appears in both the equations, a trial and error solution must be carried out to find a value that satisfies both.

The above angle computation assumes that the incoming flow velocity distribution is constant across the inlet pipe cross section. Unfortunately, slurries of large particles (of say 150 micron and more) are generally not homogeneous. a non-homogenous behavior. If the mean velocity of flow is several meters per second, then the particles or solids will be distributed throughout the body of the flow by turbulent diffusion, but there will be a measurable decrease of concentration with height (Hsu et al, 1980). This type of flow is described as pseudo-homogenous and shares with truly homogeneous flow the property that the pressure gradient increases with throughput velocity in a fluid-like fashion.

The velocity at which a particle falls in a liquid is determined by its size, shape, solids SG and the mean mixture density of the fluid in which it is falling.

Most slurries are composed of solids of SG of 2.65 and a typical slurry concentration is of the order of 20% by volume.

The hindered settling velocity for a variety of different sized solids is as shown in the table below.

SETTLING OF SOLIDS PARTICLES IN A LIQUID

| | | | |
|---|---|---|---|
| Solids particle S.G. | 2.650 | | |
| Shape factor K | 0.260 | Carrier liquid S.G. | 0.998 |
| Value of G (ft/sq 2) | 32.170 | Absolute viscosity (lbf-s/ft 2) | .0000205 |
| Slurry concetration by VOL (%) | 20.0 | Specific weight of fluid (lbs/ft 3) | 62.3 |

| PARTIC DIA MICRONS | DIMENS DIA D | PARTIC RENO NO RE | DIMENS VEL Vt* | SPHERE TER VEL ft/s | SHAPE FACT K | SHAPE COR ZETA | TERMIN VEL ft/s | HIND INDEX N | HINDERED SET VEL ft/s |
|---|---|---|---|---|---|---|---|---|---|
| 50 | 1 | 0.115 | 0.09 | 0.0074 | 0.260 | 0.517 | 0.0098 | 4.600 | 0.0014 |
| 100 | 3 | 0.851 | 0.33 | 0.0275 | 0.260 | 0.520 | 0.0143 | 4.421 | 0.0053 |
| 150 | 4 | 2.439 | 0.64 | 0.0524 | 0.260 | 0.528 | 0.0277 | 4.025 | 0.0113 |
| 200 | 5 | 5.104 | 1.00 | 0.0823 | 0.260 | 0.551 | 0.0454 | 3.738 | 0.0197 |
| 250 | 6 | 8.595 | 1.34 | 0.1109 | 0.260 | 0.562 | 0.0623 | 3.548 | 0.0282 |
| 300 | 8 | 12.773 | 1.66 | 0.1373 | 0.260 | 0.568 | 0.0780 | 3.411 | 0.0365 |
| 350 | 9 | 18.395 | 2.05 | 0.1695 | 0.260 | 0.572 | 0.0970 | 3.288 | 0.0466 |
| 400 | 10 | 24.975 | 2.44 | 0.2014 | 0.260 | 0.581 | 0.1170 | 3.189 | 0.0574 |
| 450 | 12 | 32.465 | 2.82 | 0.2327 | 0.260 | 0.581 | 0.1352 | 3.107 | 0.0676 |
| 500 | 13 | 40.818 | 3.19 | 0.2633 | 0.260 | 0.581 | 0.1590 | 3.036 | 0.0777 |

Gravity will promote particle settling and granular contact with the particles that have settled. Thus, a blade inlet angle that is optimized for reduced wear based upon a substantially homogeneous or nonstriated slurry would suffer increased wear when the blade encounters the striated layer of concentrated solids at the bottom of the conduit.

When the flow is fully stratified, the particles are concentrated in the lower portion of the pipe will come in contact with each other and with the pipe wall. This contact can be continuous, as occurs with a stationary or sliding bed of solids, or it can be sporadic, as occurs when the particles travel in a jumping motion known as saltation. The case of continuous contact is well known in the mechanics of granular soils and other materials composed of large collections of cohesionless particles.

There are however several forces which inhibit settling. Some, i.e. Brownian motion and surface forces, are significant only for small particles, for larger particles hydraulic lift forces can be significant. Such hydraulic forces can include those produced by strong velocity gradients and by particle rotation. For turbulent flow, the normal condition for settling slurries, turbulent flow, the normal condition for settling slurries, turbulent diffusion tends to even out differences in solids concentration.

Aqueous slurries having medium size particles (say 150 μm, which is in the fine-sand range) will commonly exhibit As illustrated above, the hindered settling velocity for a variety of different sized solids is less than 100% of those of normal horizontal mean conveying velocities.

Figure 2:
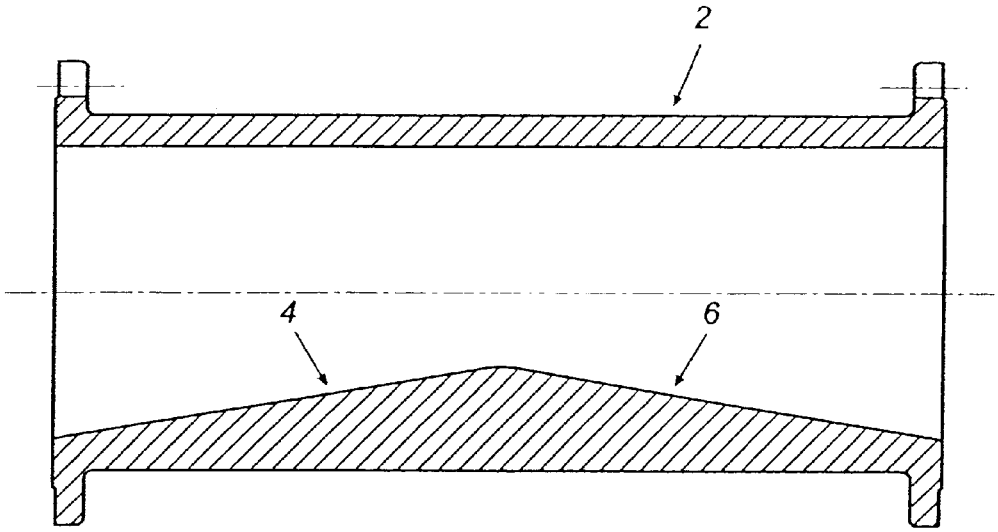
FIG. 2 is a cross sectional view of the conduit having an inclined upstream section for reducing a concentration gradient.

FIG. 2 illustrates an embodiment with a conduit section having an inclined placed in the lower section of the conduit. The inclined upstream section has a reduced cross section whereby a concentration gradient formed within the slurry conduit is reduced upon being uplifted. The inclined section forces any sliding bed or stratified slurry upwards as it goes towards the apex of the reduced section. As the slurry leaves the reduced cross section, it falls slowly back to the bottom of the pipe as determined by its settling velocity. Before the slurry can settle it enters the centrifugal pump where the slurry has a substantially monolithic or nonstriated composition, which reduces the wear on the pump. Thus, the vane inlet wear is substantially a function of the difference in the particle velocity and the velocity set for the vane.

Figure 6:
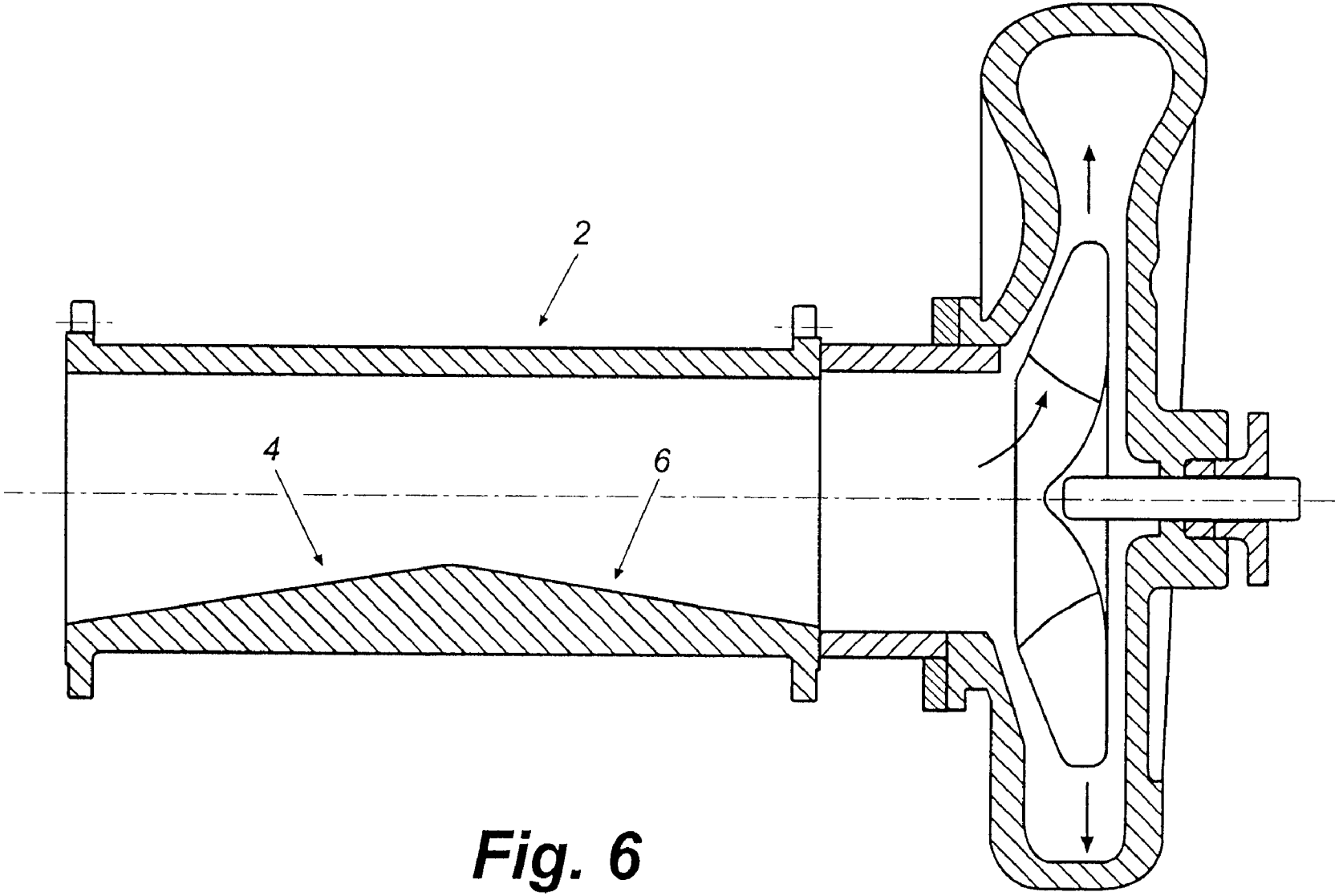
FIG. 6 is a cross sectional view of the centrifugal pump having an inclined section placed upstream of the inlet of the centrifugal pump.

The inclined section illustrated in FIG. 2 is placed upstream of the inlet of the centrifugal pump. FIG. 6 further illustrates the inclined section of FIG. 2 being placed upstream of the inlet of the centrifugal pump as illustrated in FIG. 1. The positioning of the inclined section relative to the centrifugal pump inlet is determined by the known average velocity at which the solids fall in the liquid slurry as illustrated in the table above. Often the setting velocity of the slurry is less than about 5% of the horizontal velocity of the slurry. Typically, the resulting distance is about 3 to about 10 conduit diameters from the centrifugal pump inlet.

The incline section typically rises at an angle of about 10° to 30° from the bottom section of the conduit. Of course, the angle may be greater or smaller. For example, the incline angle may rise at an angle of about 1° from the bottom section of the conduit so long as the incline section rises to a sufficient height to adequately reduce the striation of the slurry flow to decrease the wear on the inlet vanes. Additionally, the incline may comprise the same material as the conduit or may be made of a different material. In one embodiment, the incline comprises the same material as the conduit and is integral with the conduit for increased durability.

The incline can rise from the bottom of the conduit to a height of about 15% to about 45% of the total diameter of the conduit. Of course other heights may be acceptable depending upon the type of solids within the slurry and the location of the incline relative to the inlet of the centrifugal pump. For example, a solid slurry with a low setting rate would require a smaller incline than one with a high settling rate, such as slurries having large diameter solids.

Figure 3:
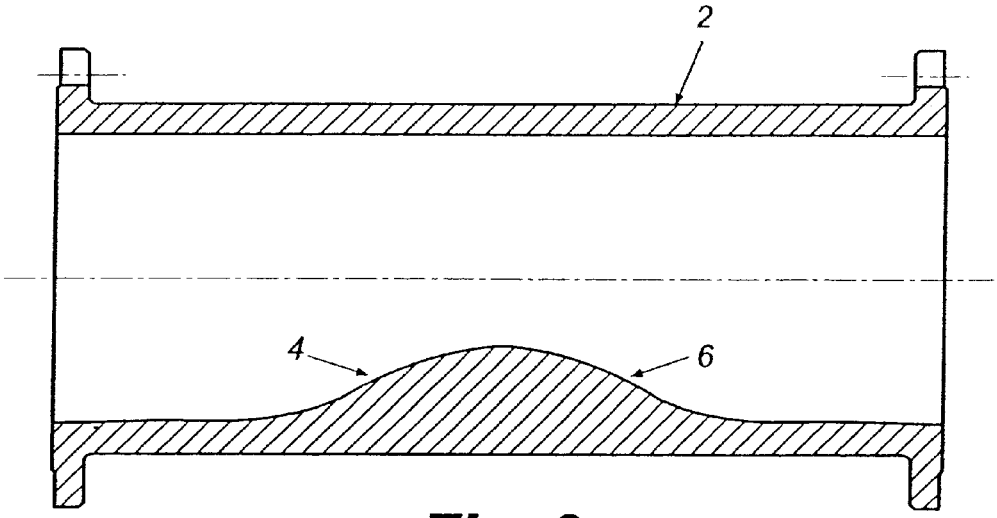
FIG. 3 is a cross sectional view of the conduit having a parabolic inclined upstream section for reducing a concentration gradient.

The incline illustrated in FIG. 2 shows a declining portion abutted to the apex portion of the incline. The declining portion reduces the effect of turbulence which would otherwise occur if the incline portion where simply to just drop off at the apex forming a perpendicular wall to the bottom portion of the conduit. Turbulence can decrease the pressure or head within the conduit. In an embodiment, the incline section may be formed without a declining portion or the declining portion may be formed at an angle which differs from that of the incline. Additionally, as illustrated in FIG. 3, the incline may have a parabolic shape.

Figure 4:
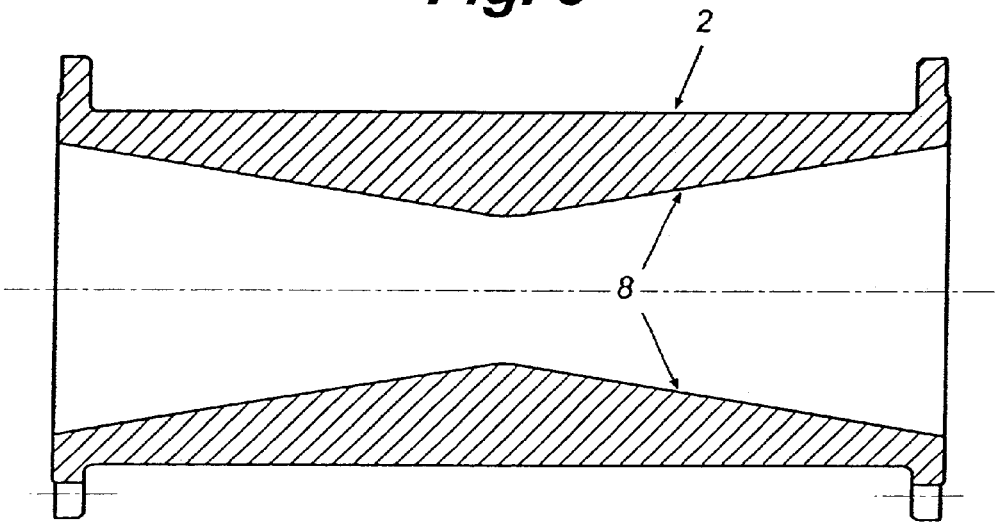
FIG. 4 is a cross sectional view of the conduit having a venturi section for reducing a concentration gradient.

Illustrated in FIG. 4, is an embodiment showing a conduit section 2 having a venturi structure 8 placed within. The venturi structure provides an uplifting force for picking up the sliding bed, and reducing the concentration gradient (depending on the amount of diameter reduction) of the slurry as it goes through the reduced diameter section.

A venturi 8 is preferably made up of circular pipe 2 that tapers inward from a diameter similar to the pump suction inlet to a smaller diameter over an included angle of about 10 to 30 degrees. An additional embodiment including an angle of about 15 degrees. The angle is primarily chosen depending upon the length of the incline and the desired increase in the velocity of the fluid flowing inside the pipe at the reduced diameter section. Additionally, the conduit or pipe 2 may be tapered outwards at about the same angle back to the pump suction diameter, then the velocity inside the pipe 2 will reduce back down again with very little loss in overall pressure or turbulence.

The pipe 2 walls on the lower side will force any sliding bed or stratified slurry upwards as it goes towards the reduced diameter section. As it comes out of the reduced diameter section, the slurry will fall slowly back down towards the bottom of the pipe 2.

If the suction of the pump is placed a short distance downstream of the reduced diameter section, then because the low settling velocity ($1/100^{th}$ or so of horizontal velocity) relative to the normal horizontal (10–15 ft/sec) conveying velocity, the particles will not have had time to settle back down again before they reach the pump, in which case the particle concentration and velocity gradient will be much more even and closer to the mean than would have been otherwise.

If the venturi 8 above were of the eccentric type with the small diameter section offset upwards, then the particles would be lifted higher and would be conversely more evenly dispersed.

The above need not be restricted to circular sections of pipe 2, a circular pipe with a graduated flat lump in the bottom of the pipe that tapered upwards and downwards producing a reduced area at the highest point would eliminate the mixture stratification and even up the particle velocities.

While specification embodiments have been set forth as illustrated and described above, it is recognized that variations may be made with respect to disclosed embodiments. These can include other known continuous or discontinuous process variations. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

What is claimed is:

1. A slurry conduit for connecting to a suction inlet of a centrifugal pump for transporting a slurry mix of solids and liquids comprising:

an inclined upstream section having a reduced cross section and the inclined upstream section placed upstream of the suction inlet whereby a concentration gradient formed within the slurry conduit is reduced.

2. The slurry conduit of claim 1, wherein the inclined upstream section is followed by a declining downstream section to reduce turbulence.

3. The slurry conduit of claim 1, further comprising a lower section disposed below and integral with an upper section of the conduit.

4. The slurry conduit of claim 3, wherein the inclined upstream section is disposed within the lower section.

5. The slurry conduit of claim 3, wherein the inclined upstream section is disposed within both the lower section and the upper section of the conduit.

6. The slurry conduit of claim 3, wherein the inclined upstream section slopes up from the bottom section of the conduit at an angle of between about 10° to about 30°.

7. The slurry conduit of claim 1, wherein the slurry having a settling velocity of less than about 5% of a horizontal velocity of the slurry.

8. The slurry conduit of claim 1, wherein the inclined upstream section rises to a height from the bottom section of the conduit between about 15% to about 45% of the total diameter of the conduit.

9. The slurry conduit of claim 1, wherein the inclined upstream section is located about 3 to about 10 conduit diameters from the centrifugal pump.

10. A process for reducing a concentration and velocity gradient formed within a slurry conduit comprising the steps of:

uplifting a portion of the slurry within the conduit; and delivering a substantially nonstriated slurry stream to a section inlet of a centrifugal pump.

11. The process of claim 10, wherein the step of uplifting the portion of the slurry includes uplifting a layer of particles having a velocity lower than a mean velocity of the slurry.

12. The process of claim 10, wherein the substantially nonstriated slurry stream has a velocity which is substantially similar to a zero shock velocity of the centrifugal pump.

13. The process of claim 10, wherein the slurry is uplifted at an angle of between about 10° to about 30° from horizontal.

14. The process of claim 10, wherein the slurry has a settling velocity of less than about 5% of a horizontal velocity of the slurry.

15. The process of claim 10, wherein the slurry is uplifted to a point of between about 15% to about 45% of the total diameter of the conduit.

16. The process of claim 10, wherein the slurry is uplifted at a location of about 3 to about 10 conduit diameters from the centrifugal pump.

17. A slurry conduit for connection to a suction inlet of a centrifugal pump for transporting a slurry mix of solids and liquids comprising:

a venturi section having a reduced cross section and the venturi section placed upstream of the suction inlet whereby a concentration gradient formed within the slurry conduit is reduced.

18. The slurry conduit of claim 17, wherein the venturi section slopes up from horizontal at an angle of between about 10° to about 30°.

19. The slurry conduit of claim 17, wherein the slurry having a settling velocity of less than about 5% of a horizontal velocity of the slurry.

20. The slurry conduit of claim 17, wherein the venturi section reduces a cross section of the conduit between about 15% to about 45% of the total diameter of the conduit.

21. The slurry conduit of claim 17, wherein the venturi section is located about 3 to about 10 conduit diameters from the centrifugal pump.

* * * * *